US005341577A

United States Patent [19]

Hashimoto et al.

[11] Patent Number: 5,341,577

[45] Date of Patent: Aug. 30, 1994

[54] DRYING METHOD OF AND DRYING APPARATUS FOR POWDER AND GRANULAR MATERIAL

[75] Inventors: Iori Hashimoto, Kyoto; Motoki Numata, Munakata; Jun Nishizawa; Tomiyuki Kamada, both of Kitakyushu, all of Japan

[73] Assignee: Mitsubishi Kasei Corporation, Tokyo, Japan

[21] Appl. No.: 94,437

[22] Filed: Jul. 21, 1993

[30] Foreign Application Priority Data

Jul. 21, 1992 [JP] Japan ..... 4-193852

[51] Int. Cl.[5] ..... F26B 3/00

[52] U.S. Cl. ..... 34/493; 34/132; 34/551; 236/1 E

[58] Field of Search ..... 34/26, 30, 43, 44, 46, 34/48, 108, 132, 215; 431/80; 432/112, 107; 236/1 E

[56] References Cited

U.S. PATENT DOCUMENTS 4,660,298 4/1987 Nambu et al. ..... 34/48
5,205,050 4/1993 Masaaki et al. ..... 34/48

FOREIGN PATENT DOCUMENTS

63265/65 3/1967 Australia .
0146826 7/1985 European Pat. Off. .
0254441 1/1988 European Pat. Off. .
1600373 10/1981 United Kingdom .

*Primary Examiner*—Denise Gromada
*Attorney, Agent, or Firm*—Oblon, Spivak, McClelland, Maier & Neustadt

[57] ABSTRACT

Carbon black is introduced into a granulating machine 3 through an inlet 1 and water is introduced into the same through an inlet 2 to prepare granulated carbon black, which is fed to a cylindrical rotary type dryer 5 through a line 4 and is dried. A product of carbon black is discharged through a line 6. Temperature in the dryer 5 is measured by a plurality of thermometers 10. A combustion control device performs the arithmetical processing of temperature data to obtain the initial point at which the state of the carbon black is changed from the constant rate of drying to the falling rate of drying. The control device controls each flow rate of fuel supplied from each line 7 or 8 to burners 9 for the front and rear half portions of the dryer by using the critical point and the temperature of the carbon black at the outlet of the dryer, whereby a temperature profile for the carbon black in the dryer 5 can be made stable for a long time.

14 Claims, 11 Drawing Sheets

DRYING METHOD OF AND DRYING APPARATUS FOR POWDER AND GRANULAR MATERIAL

The present invention relates to a drying method of and a drying apparatus for powder and granular material. More particularly, the present invention relates to a method of and an apparatus for drying powder and granular material such as carbon black in a dryer under a stable temperature profile.

When powder and granular material such as carbon black is continuously dried, for instance, the physical properties of carbon black obtained vary depending on conditions of drying. Accordingly, it was necessary to dry the material under constant conditions of drying.

Heretofore, as a dryer for drying carbon black which is a typical example of the powder and granular material, a cylindrical rotary type dryer having a plurality of heat sources which are located in sections divided into a front half portion and a rear half portion in a transferring path of the dryer, is used. The quantity of heat from the heat sources in the dryer is so controlled that the thermal capacity of carbon black containing water to be fed to the dryer is previously calculated; the flow rate of fuel for the heat sources located in the front half portion is adjusted to produce the same quantity of heat as the thermal capacity, and the flow rate of fuel for the heat sources located in the rear half portion is adjusted depending on the temperature of the carbon black at the outlet of the dryer.

In the control method of drying the carbon black in the cylindrical rotary type dryer, a feed back control is applied only to the temperature of the carbon black at the outlet of the dryer whereby the temperature can be controlled to have a desired temperature. However, it was found that the degree of oxidization and water content in a product of carbon black, which show indices for the quality of the product are largely influenced by a history of heating of the carbon black, namely, a temperature profile of not only the temperature at the outlet but also the inside of the dryer. The reason is as follows. Even when the carbon black is supplied with a fixed water content into the dryer, the water content and the feeding speed of the carbon black dilicately change in the actual industrial processes, with the result that the physical properties of the carbon black which is finally obtained by drying show a dilicate change. Accordingly, it is unclear in the conventional method that even when the temperature at the outlet of the dryer shows a desired temperature, the degree of oxidization, the water content and so on in the product, which are the indices of the quality of the products, are desired values.

Further, when the quantity of heat of the heat sources in the front half portion of the dryer is adjusted depending on an amount of the water-containing carbon black to be supplied to the dryer, the temperature of the outlet will change because the quantity of heat in the front half portion influences the temperature at the outlet.

It is an object of the present invention to provide a drying method of and a drying apparatus for powder and granular material such as carbon black which can provide a stable temperature profile in a dryer for a long time whereby the quality of products of powder and granular material can be increased.

It is another object of the present invention to provide a method of controlling the temperature profile desirably in the dryer.

The inventors of this application have intensively studied methods of drying powder and granular material and have completed the present invention. Namely, they have established a multi-variable control system wherein the temperature of powder and granular material is measured by a plurality of thermometers located in a dryer; the measured temperature data are processed by arithmetical operations to obtain the critical point at which the powder and granular material shifts from the constant rate of drying to the falling rate of drying; the critical point and the temperature of the powder and granular material at the outlet of the dryer are used as variables to be controlled; and the flow rate of fuel to be supplied to heat sources located in the front half portion of the dryer and the flow rate of fuel in the rear half portion are used as operating variables, and wherein a temperature profile of the powder and granular material in the dryer can be stably maintained for a long time in a case that the flow rate of fuel as the operating variables are determined by arithmetical operations.

In accordance with the present invention, there is provided a drying method of powder and granular material which dries powder and granular material within a time from the introducing of the same from an end of a dryer having heat sources in plurally divided sections to the discharging of the same from the other end, wherein the temperature of the powder and granular material in the dryer is measured; the critical point at which a state of drying of the powder and granular material is changed from the constant rate of drying to the falling rate of drying is estimated by calculation on the basis of a result of the temperature measurement and the temperature of the powder and granular material at the outlet of the dryer; and the temperature of the powder and granular material at the outlet of the dryer and the critical point are controlled by operating independently the quantity of heat of the plural heat sources on the basis of a result of the estimation of the critical point concerning the state of drying of the powder and granular material.

In accordance with the present invention, there is provided a drying apparatus for drying powder and granular material by heat sources located in plurally divided sections in a dryer having a powder and granular material feeding path which connects an inlet for the powder and granular material at its one end to an outlet at its other end, wherein the drying apparatus comprises:

temperature measuring devices for measuring the temperature of the powder and granular material at a plurality of locations in the powder and granular material feeding path in the dryer;

a drying-state-critical-point estimation means for estimating by calculation the critical point at which the drying state of the powder and granular material changes from the constant rate of drying to the falling rate of drying, on the basis of a result of the measurement of the powder and granular material by the temperature measuring devices; and a combustion control device which operates independently the quantity of heat from the plurality of heat sources on the basis of a result of the estimation by the drying-state-critical-point estimation means and the temperature of the powder and granular material at the outlet of the dryer, whereby the temperature of the powder and granular material at the outlet of the dryer and the critical point of the drying state are controlled.

The powder and granular material to be treated in the present invention may be carbon black, fertilizer, dye, pigment, synthetic resin pellets of a material such as polyamide resin or powder for surface coating. In particular, the present invention is suitably applied to the drying powder and granular material such as carbon black in which the characteristics are changed in a falling rate drying region. Further, liquid contained in the powder and granular material may be organic solvent instead of water.

As a typical example of the powder and granular material, carbon black will be described.

As described before, there occurs thermal oxidization at the surface of the carbon black in a falling rate drying time whereby an amount of oxygen functional groups such as carboxyl group is changed. Further, the degree of oxidization of the surface of the carbon black largely influences the quality of the product of carbon black. The degree of oxidization can be measured by VM (volatile matter: volatile component) and pH values (the detail of measuring methods is described in JIS 6221).

Figure 4A:
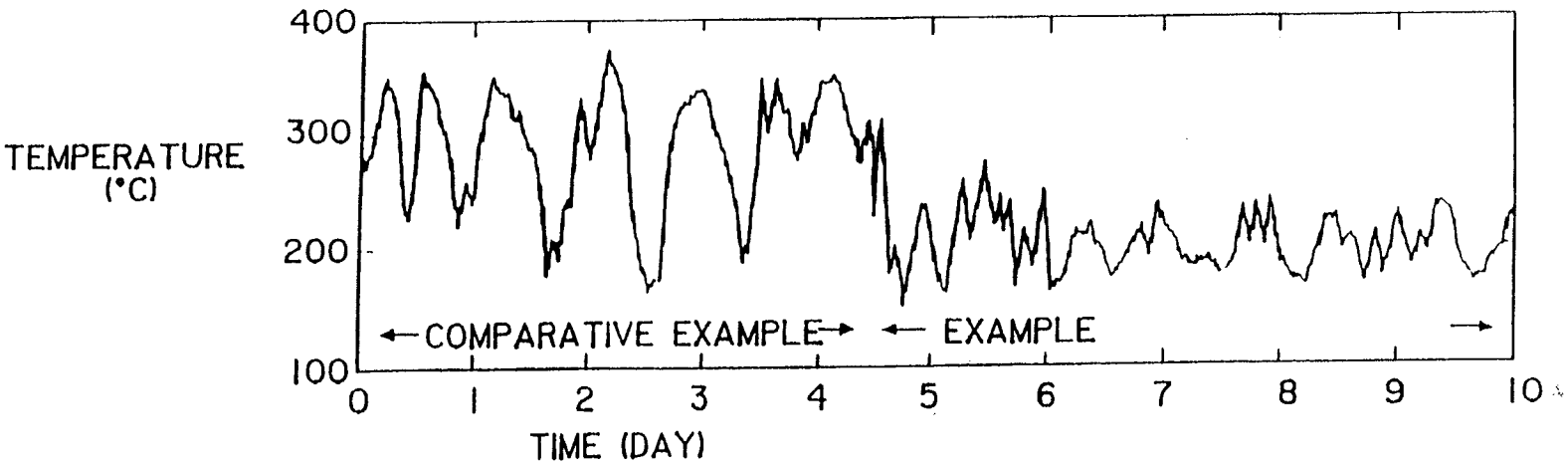
Figure 4B:
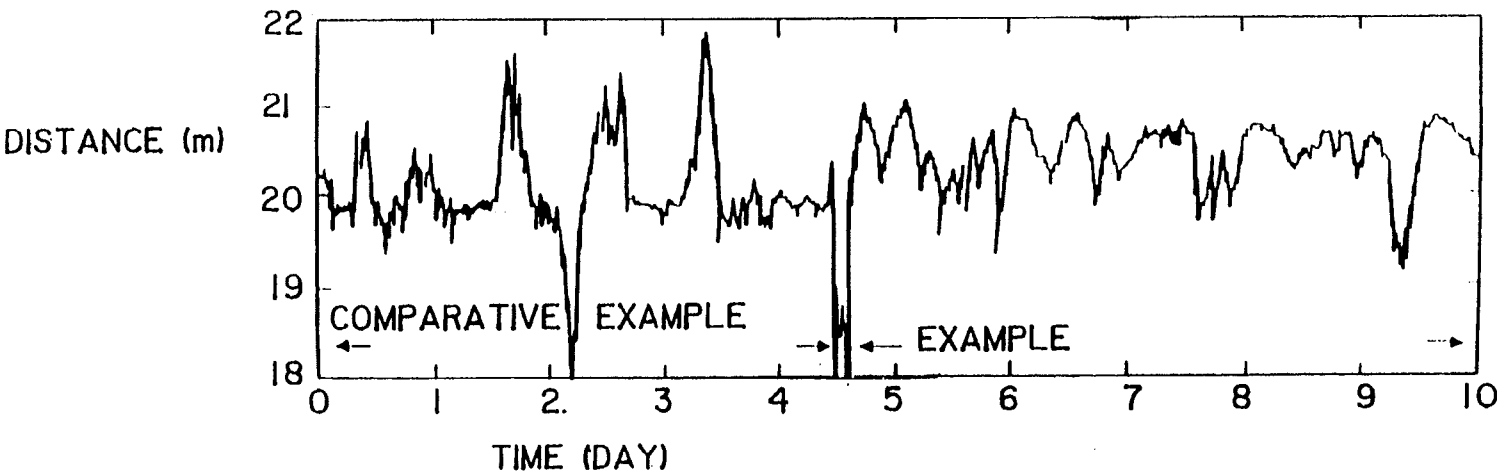
Figure 5A:
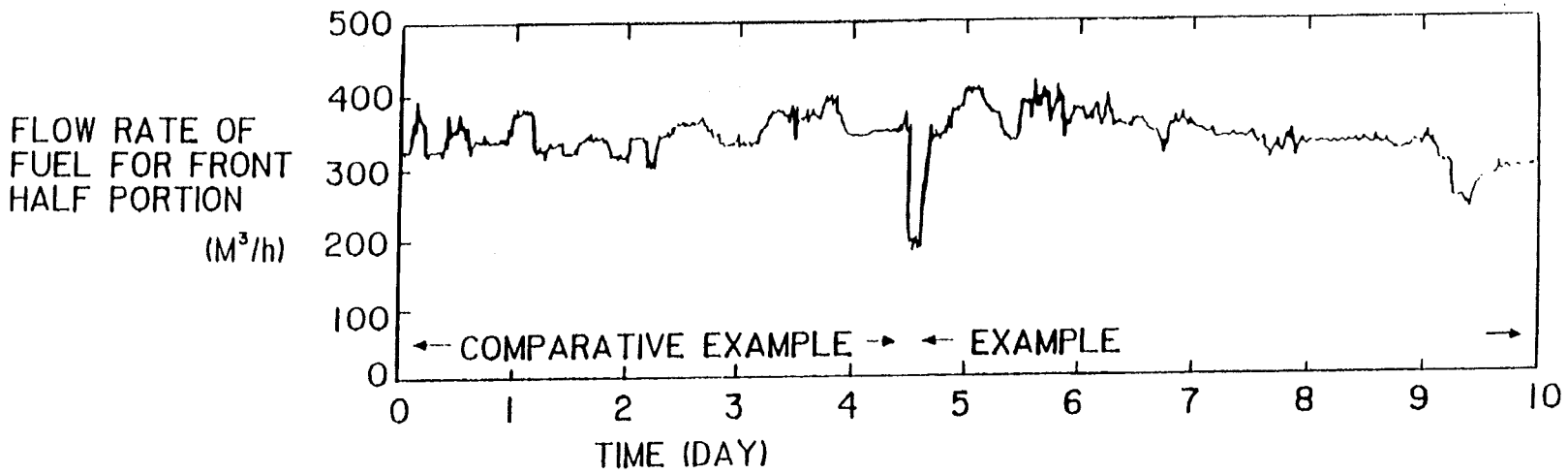
Figure 5B:
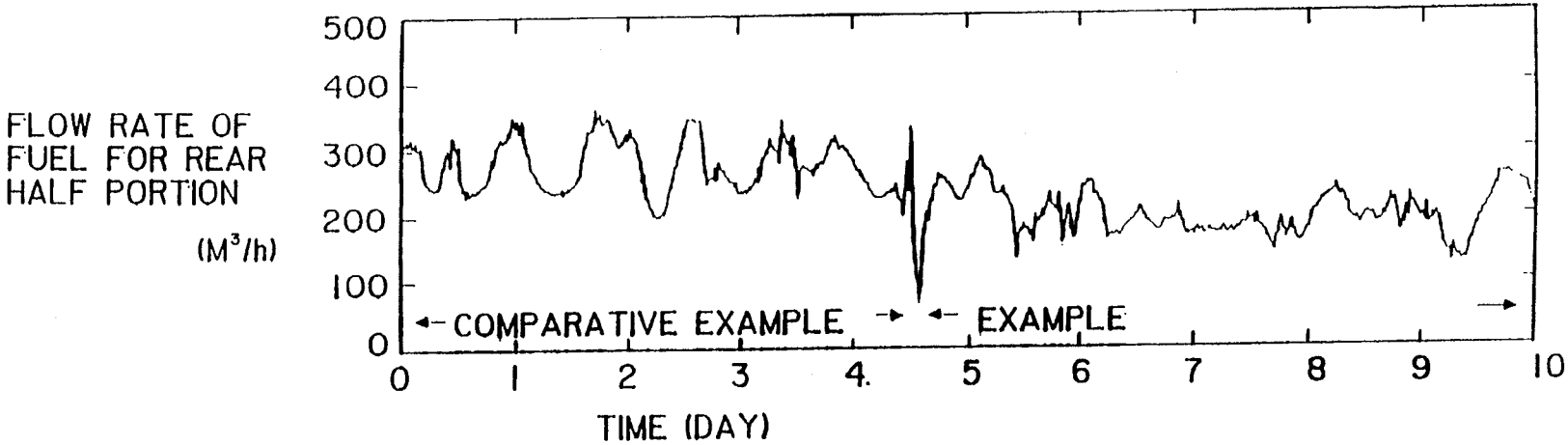

FIG. 4*a* is a diagram showing the temperature of carbon black at the outlet of a dryer in an example of the present invention in comparison with a comparative example;

FIG. 4*b* is a diagram showing the distance from the inlet of a dryer at a critical point turning from the constant rate of drying to the falling rate of drying;

FIG. 5*a* is a diagram showing the the flow rate of fuel in the front half portion of a dryer in an example of the present invention in comparison with a comparative example;

FIG. 5*b* is a diagram showing the flow rate of fuel in the rear half portion in the same manner as FIG. 5*a;*

Figure 6:
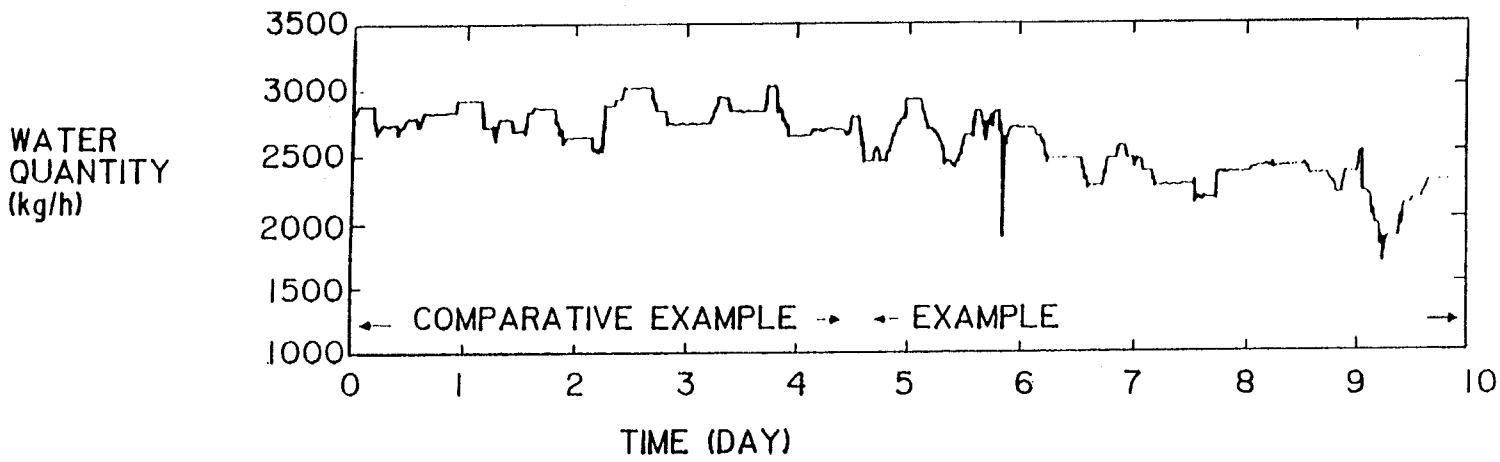
Figure 7:
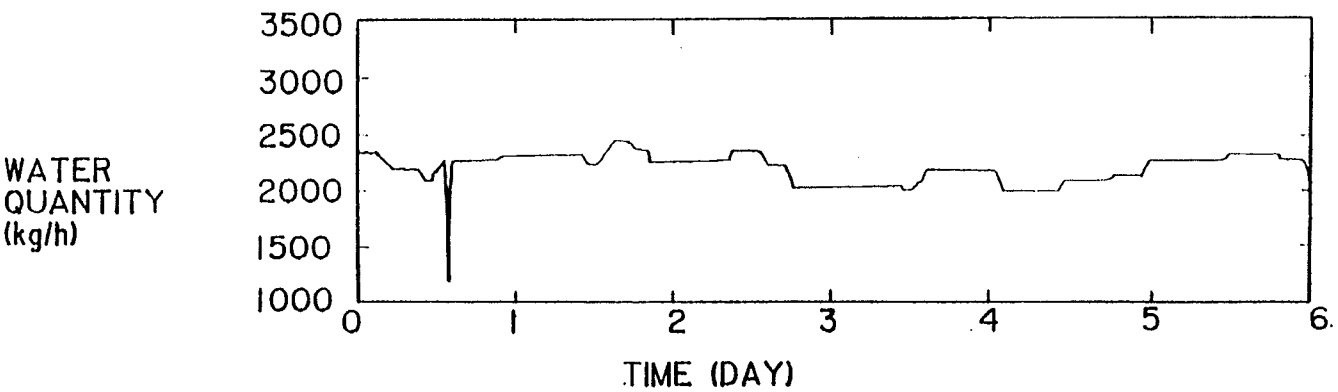
Figure 8A:
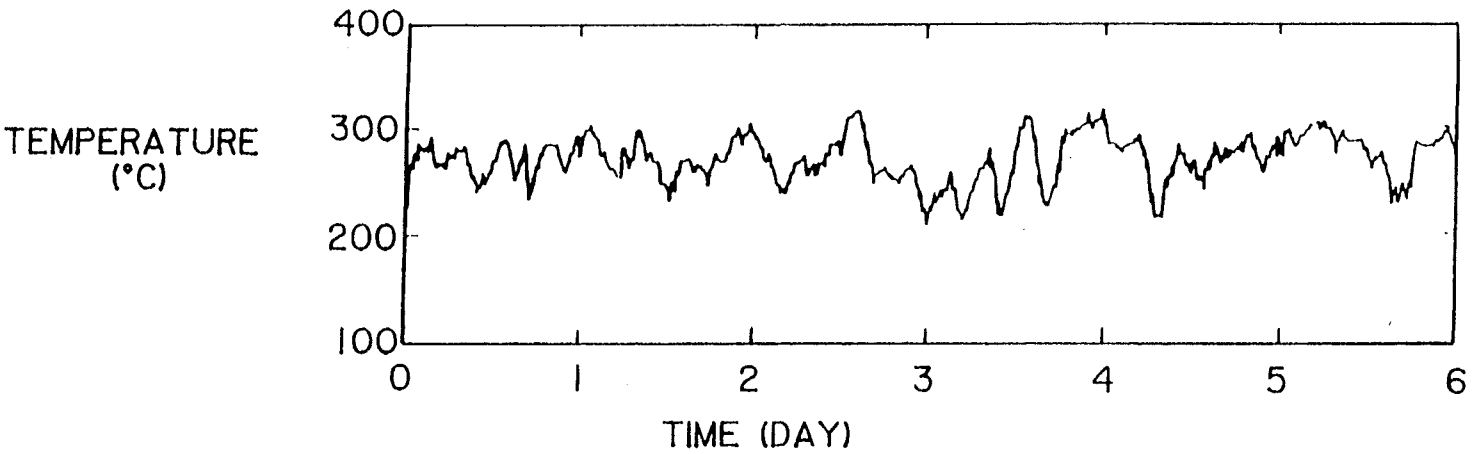
Figure 8B:
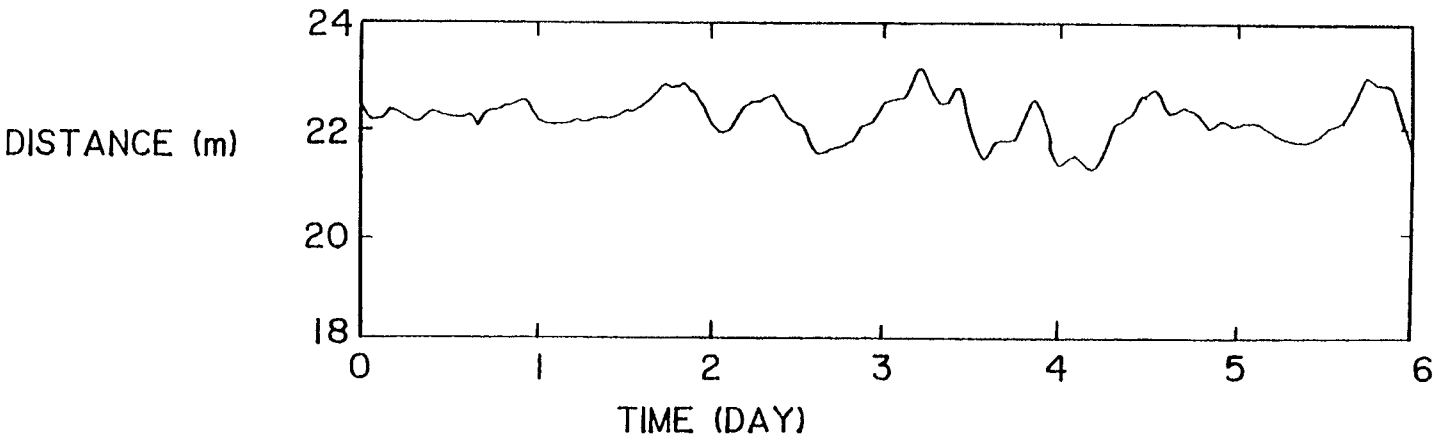
Figure 8C:
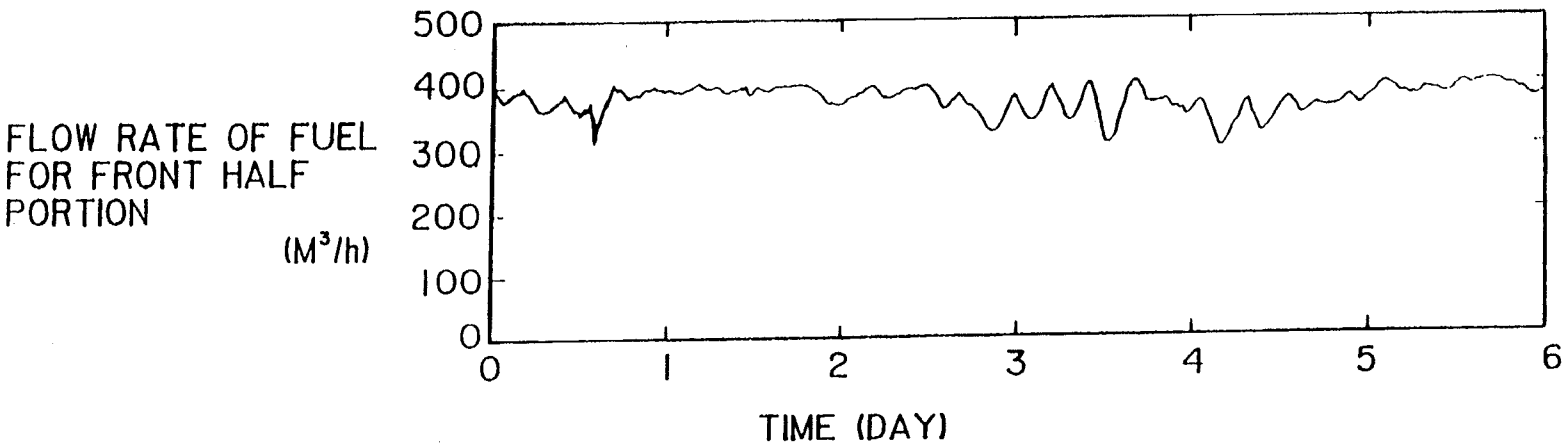
Figure 8D:
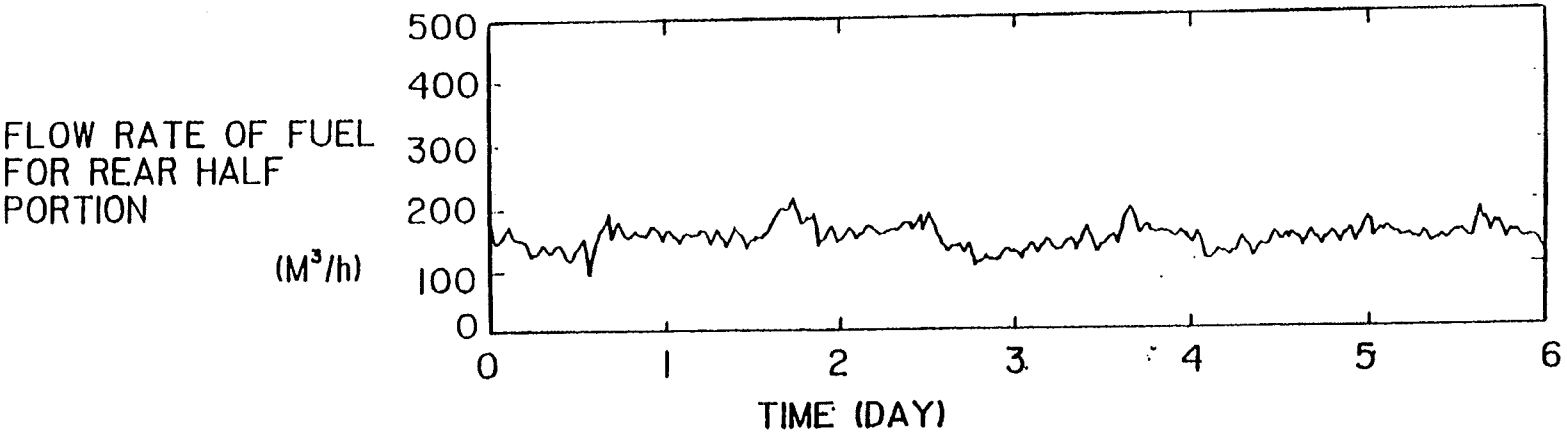
Figure 9:
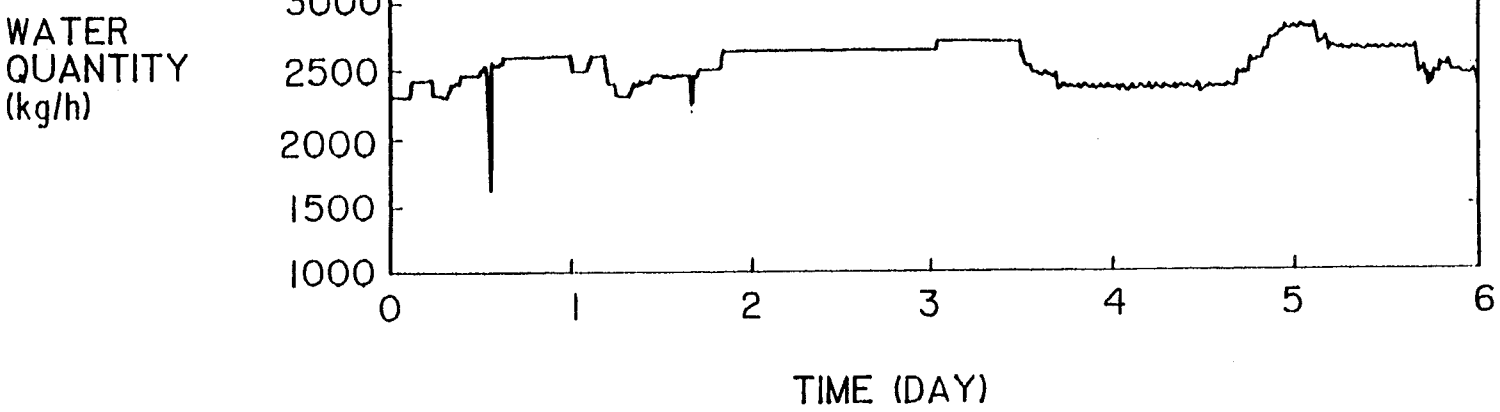
Figure 10A:
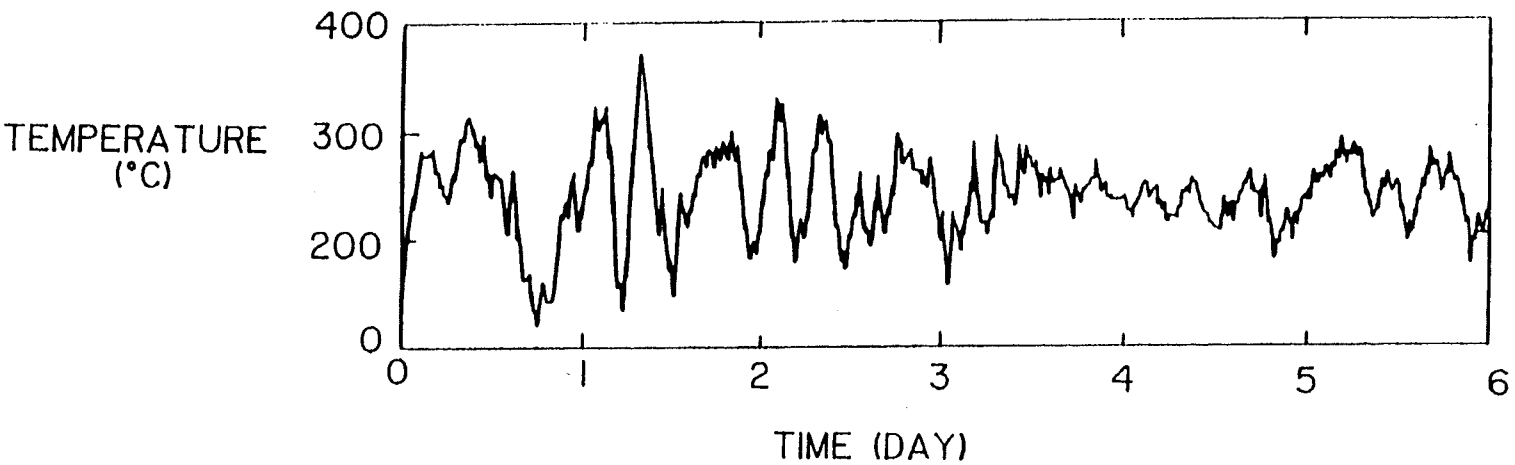
Figure 10B:
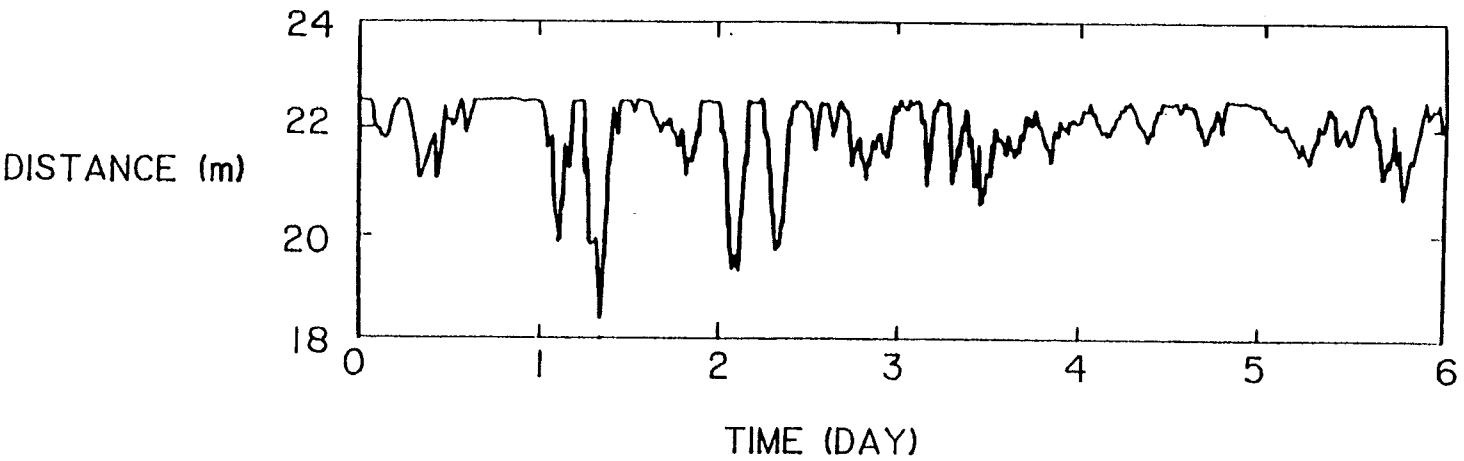
Figure 10C:
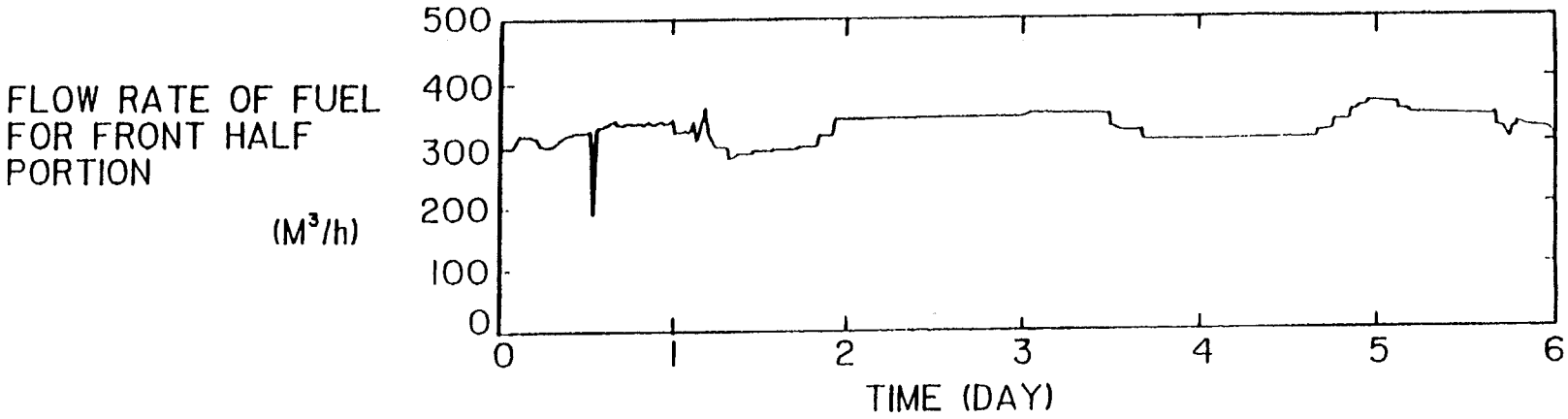
Figure 10D:
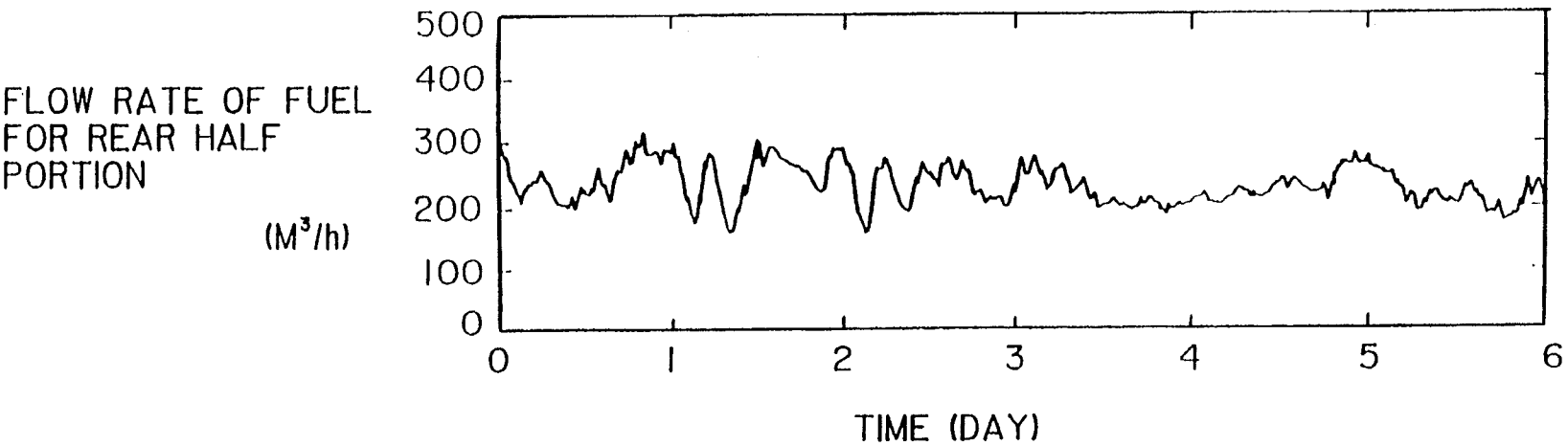

FIG. 6 is a diagram showing the water content added to carbon black in a dryer according to an example of the present invention in comparison with a comparative example;

FIG. 7 is a diagram showing the water content added to carbon black in Example 3 of the present invention;

FIG. 8*a* is a diagram showing the temperature of carbon black at the outlet of the dryer in Example 3;

FIG. 8*b* is a diagram showing the distance from the inlet of the dryer from the critical point turning from the constant rate of drying to the falling rate of drying;

FIG. 8*c* is a diagram showing the flow rate of fuel to be supplied to the front half portion of the dryer;

FIG. 8*d* is a diagram showing the flow rate of fuel to be supplied to the rear half portion of the dryer;

FIG. 9 is a diagram showing the water content added to carbon black in Comparative Example 2;

FIG. 10*a* is a diagram showing the temperature of the carbon black at the outlet of the dryer in Comparative Example 2;

FIG. 10*b* is a diagram showing the distance from the inlet of the dryer to the critical point turning from the constant rate of drying to the falling rate of drying in Comparative Example 2;

FIG. 10*c* is a diagram showing the flow rate of fuel supplied to the front half portion of the dryer in Comparative Example 2; and FIG. 10*d* is a diagram showing the flow rate of fuel supplied to the rear half portion of the dryer in Comparative Example 2.

The present invention will be described in more details.

Figure 2:
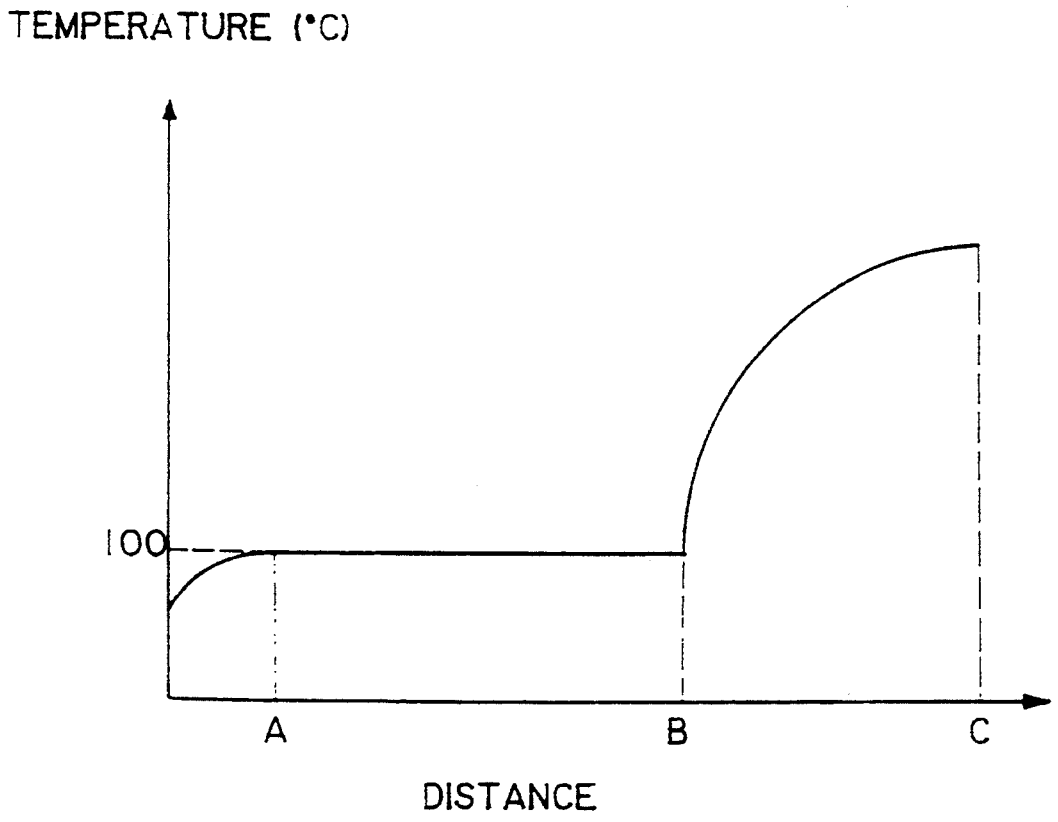
FIG. 2 is a diagram showing a typical example of a temperature profile in a dryer for carbon black to be granulated by adding water in accordance with the present invention.

FIG. 2 is a diagram showing a temperature profile of carbon black as powder and granular material in a cylindrical rotary type dryer as a typical example of a dryer, wherein the ordinate represents temperature and the abscissa represents the distance from the inlet of the dryer. The powder and granular material (carbon black) supplied at about 60° C. is heated to reach 100° C. (a point A) which is the boiling point of water. The temperature of 100° C. continues for a fixed time (a time period of the constant rate of drying). Then, when the evaporation of free water at the surface finishes to enter into a time period of the falling rate of drying (a point B), the temperature increases beyond 100° C. In the measurement of temperature, it is preferable that a leading temperature measuring device for measuring the temperature of the carbon black is located at least near the point B, the final temperature measuring device is located at the outlet (a point C) of the dryer, and a plurality of temperature measuring devices are located between the leading and final temperature measuring devices. The position of the point B may be determined in trial during operations while the position of the temperature measuring devices are moved.

In accordance with the drying method of powder and granular material of the present invention, a critical point at which a state of carbon black shifts from the constant rate of drying to the falling rate of drying in the dryer is estimated from temperature data measured by a plurality of temperature measuring devices located in the dryer; the quantity of heat of heat sources disposed in plurally divided sections in the dryer is controlled on the basis of the estimated critical point and the temperature of the powder and granular material at the outlet of the dryer, whereby the temperature of the carbon black at the outlet of the dryer and the critical point to the falling rate of drying can be controlled. As a result, the temperature profile in the dryer can be stable and products of carbon black having constant degree of oxidization and water content can be obtained.

In the following, the detail of the arithmetical operations to obtain a product of carbon black will be described.

In the present invention, the critical point between the constant rate of drying and the falling rate of drying in the dryer can be obtained from temperature data measured by a plurality of the temperature measuring devices disposed in the cylindrical rotary type dryer. Namely, when carbon black granulated by adding water is used, the temperature of the carbon black in a state of the constant rate of drying is 100° C. which is the boiling point of water. However, when the carbon black is in a state of the falling rate of drying, the temperature exceeds 100° C. Accordingly, there must be the critical point turning to the falling rate of drying between a temperature measuring device which shows 100° C. and another temperature measuring device which shows a temperature beyond 100° C.

Accordingly, accuracy in detecting the critical point turning from the constant rate of drying to the falling rate drying is increased as the number of the temperature measuring devices is increased- However, there is a case that a number of the temperature measuring devices can not be disposed because of the strength of a supporter for supporting the temperature measuring devices or the cost for installing the temperature measuring devices. In this case, the critical point can be estimated from a smaller number of temperature measuring points. Namely, if the carbon black is uniformly heated by combustion gas, temperature increment in the carbon black can be expressed as a first-order capacity system of a convolution integral of a quantity of heat added, and the first-order capacity system is given by an approximate expression:

$$t=K-B\times e\times p\,(-x/T)$$

where t is temperature, x is the distance between the leading temperature measuring device in view of the inlet of the dryer (provided that condition to be satisfied is that the leading measuring device is located at at least between the B and C points in FIG. 2, i.e. in the falling rate drying region) and another temperature measuring means disposed in the falling rate drying region, and K, B and T are respectively coefficients.

In order to obtain the approximate expression, it is necessary to obtain the values of K, B and T. However, if there are three temperature measuring points which are equi-distant, tertiary simultaneous equations can be solved, and the critical point turning to the falling rate drying can be estimated from the intersection between the approximate expression and the temperature of 100° C. Thus, it is necessary to provide at least three points for the temperature measuring devices in the falling rate drying region in order to obtain the critical point from temperature measuring signals. However, if a measured value by the leading temperature measuring device is less than 100° C. because of an outer disturbance due to any cause, only two temperature values are used, whereby the tertiary simultaneous equations can not be solved. Accordingly, it is desirable to provide the temperature measuring devices at four or more number of positions.

The following procedure is needed to control the critical point and the temperature of carbon black at the outlet of the dryer.

First, a step response model is prepared for the process. The step response model shows a change with time on the behavior of the critical point and the temperature of carbon black at the outlet, which are quantities to be controlled, when a loading quantity of carbon black or a flow rate of fuel is changed in a unit flow rate. The step response model can be obtained by tests. Specifically, the flow rate of fuel and the loading quantity of the carbon black are made constant to obtain a steady state. Then, the temperature inside the dryer becomes constant, and the critical point turning from the constant rate of drying to the falling rate of drying is also constant. Then, only the flow rate of fuel for the front half portion of the dryer is instantaneously increased to 1 $Nm^3/h$, and the behavior on the temperature of the carbon black at the outlet of the dryer is recorded in a fixed period of time. At the same time, the critical point turning to the falling rate of drying is also estimated and recorded. These processes may be conducted by using a computer.

When the flow rate of fuel for the front half portion of the dryer is increased, the temperature in the dryer is increased and assumes to be a constant value. In this moment, the critical point becomes constant. When the critical point becomes constant, the recording is finished. The above-mentioned processes are also applied to the flow rate of fuel for the rear half portion of the dryer. Further, in the loading of the carbon black, the loading is instantaneously increased to 1 kg/h.

The temperature of the carbon black at the outlet of the dryer and the critical point turning to the falling rate of drying thus obtained can be expressed as time series data as follows.

$$a_0, a_1, a_2 \ldots, a_{s-1}, a_s$$

where $a_0$ is a value obtained at the time of changing the operating quantity; the data are arranged in the order from the oldest to the newest, and s is a time point at which the steady state is again obtainable.

When a series of the processes is assumed to be nearly linear, the response of the process at the time of t+j where a stepwise input of $\Delta u$ (t) is added to the process at the time t, can be expressed by:

$$y(t+j)=a_j\times\Delta u\,(t)$$

If the operations which have been conducted are such that stepwise inputs having different magnitude are successively added with a constant period, the response of the process at the time t+j can be considered in a manner that influence by the stepwise inputs in the past is added. Accordingly, the following formula (1) is obtainable:

$$y(t+j)=\sum_{k=1}^{\infty} a_k\times u(t+j-k) \qquad (1)$$

In the formula (1), which represents the step response model, an item $\Delta u$ (t+j−k) means u (t+j−k)−u (t+j−k−1) which represents a quantity of change with respect to an input of a period before.

Beside the step response model, an impulse response model or an ARX model may be used. However, the step response model is desired. By using such a process model, the behavior in future of the quantity to be controlled can be estimated. The impulse response model can be obtained through tests in the same manner as the step response model. In the tests to obtain the step response model, an stepwise input is applied. However, in the tests to obtain the impulse response model, a pulse-like input is applied. For instance, in a change of the flow rate of fuel for the front half portion of the dryer, an instantaneous increase of 1 $Nm^3/h$ is given and the flow rate is returned to the original value in the next period. Thus, time series data can be obtained in the same manner as in the step response model, namely, $$h_0, h_1, h_2, \ldots, h_{s-1}, h_s$$

where s is the time point at which the steady state is provided again.

On the assumption that the process is nearly linear, the response of the process at the time of t+j where a pulse-like input having a magnitude of u (t) is added to the process at the time of t, is expressed by:

$$y(t+j)=h_j \times u(t)$$

If the operations which have been conducted are such that pulse-like inputs having different magnitude are successively with and a constant period, the response of the process at the time of t+j can be so considered that the influence by the pulse-like inputs in the past is added, and this idea can be expressed by the following formula (2):

$$y(t+j)=\sum_{k=1}^{\infty} h_k \times u(t+j-k) \quad (2)$$

The formula (2) represents the impulse response model.

Further, the ARX model is such model that the response y (t) of the process at the current time is determined as the function of the response of the past process y (t−1), y (t−2), . . . and the past operating input u (t−1), u (t−2), . . . For instance, the ARX model has the structure as follows:

$$y(t)=b_1 \times y(t-1)+b_2 \times y(t-2)+b_3 \times y(t-3)+ c_1 \times u(t-1)+c_2 \times u(t-2)+c_3 \times u(t-3)$$

Then, a target behavior is determined. When it is desired that a quantity to be controlled is made constant, a constant value is obtained by calculation. On the other hand, it is desired that the quantity to be controlled is changed, a smooth curved line having a desired value is calculated. Thus, a track as a target is obtained.

A combustion control device is so adapted that a future behavior of the quantity to be controlled in an operation is predicted by using a process model to obtain a predicted track; an operating quantity which minimizes the surface area of error between the predicted track and a target track is obtained by using a least square method, and the flow rate of fuel for the front half portion and the flow rate of fuel for the rear half portion are adjusted so that the operating quantity becomes equal to the obtained value, whereby the quantity of heat of the heat sources in the dryer can be controlled.

Explanation will be made in detail how the operating quantity is obtained.

What is to be done first is to determine that a surface area of error between a target track and an estimated value of the response of the process which is continued for specified hours from a specified time point in future, is minimized. For instance, determination is made to minimize a surface area of error between a target track and an estimated value of the process during a time period P from a time point L ahead of the present time. More specifically, for instance, the time point L may be determined to have a value which is as long as a sampling period from the longest waste time in the process, and the period P may correspond to 6 sampling periods.

In the next, the estimation is made as to the response of the process which is continued for the time period P from the time point L ahead of the present time by using a process model. Namely, y (t+L), y (t+L+1), . . . , y (t+L+P−2), y (t+L+P−1) are estimated. In order to obtain the values, the step response model, the impulse response model or the ARX model as mentioned before can be used.

The calculation of the target track during the time period P from the time point L ahead of the present time, i.e.

$$YP=[y(t+L)\ y(t+L+1) \ldots y(t+L+P-2)\ y(t+L+P-1)]^t$$

$$YR=[y(t+L)\ y(t+L+1) \ldots y(t+L+P-2)\ y(t+L+P-1)]^t$$

is conducted as follows.

On the assumption that an operating quantity till a time point of t+L−2 is kept to be an operating quantity to be obtained from now, a response y (t+L−1) of the process at the time point of t+L−1 is estimated. A point which is obtained by the interior division of the estimated value and the target value into $1-\alpha$: $\alpha$ is determined to be y (t+L) where $\alpha$ is a number larger than 0 but smaller than 1. Then, operations are successively conducted to find a point of y (t+L+1) which is obtained by the interior division into $1-\alpha^2$: $\alpha^2$, a point of y (t+L+2) which is obtained by the interior division into $1-\alpha^3$: $\alpha^3$ and so on, whereby a target track can be formed. Here, the estimated value of the process which is continued for the time period P from the time point L ahead of the present time and the target track are expressed by vectors as follows:

$$YP=[y(t+L)\ y(t+L+1) \ldots y(t+L+P-2)\ y(t+L+P-1)]^T$$

$$YR=[y(t+L)\ y(t+L+1) \ldots y(t+L+P-2)\ y(t+L+P-1)]^T$$

where the accompanying characters represents the transposition of the vectors.

In order to minimize the surface area of error between YP and YR, a value Δu (t) which minimizes a performance function J should be obtained.

$$J=(YR-YP)^2$$

The value Δu (t) for minimizing J can be obtained by solving the following formula (3):

$$aJ/a\Delta u(t)=0 \quad (3)$$

The obtained Δu (t) represents a quantity of change with respect to an input which is provided a period before (the operating quantity at the present time can be obtained by adding the value Δu (t) to the operating quantity obtained at the last time. A series of arithmetical processing from the determination of the critical point at which a state of drying is changed from the constant rate of drying to the falling rate of drying, to the adjustment of the quantity of heat from the heat sources can be carried out by using a computer.

An example of the present invention will be described with reference to the drawings by exemplifying a drying method for carbon black.

EXAMPLE 1

Figure 1:
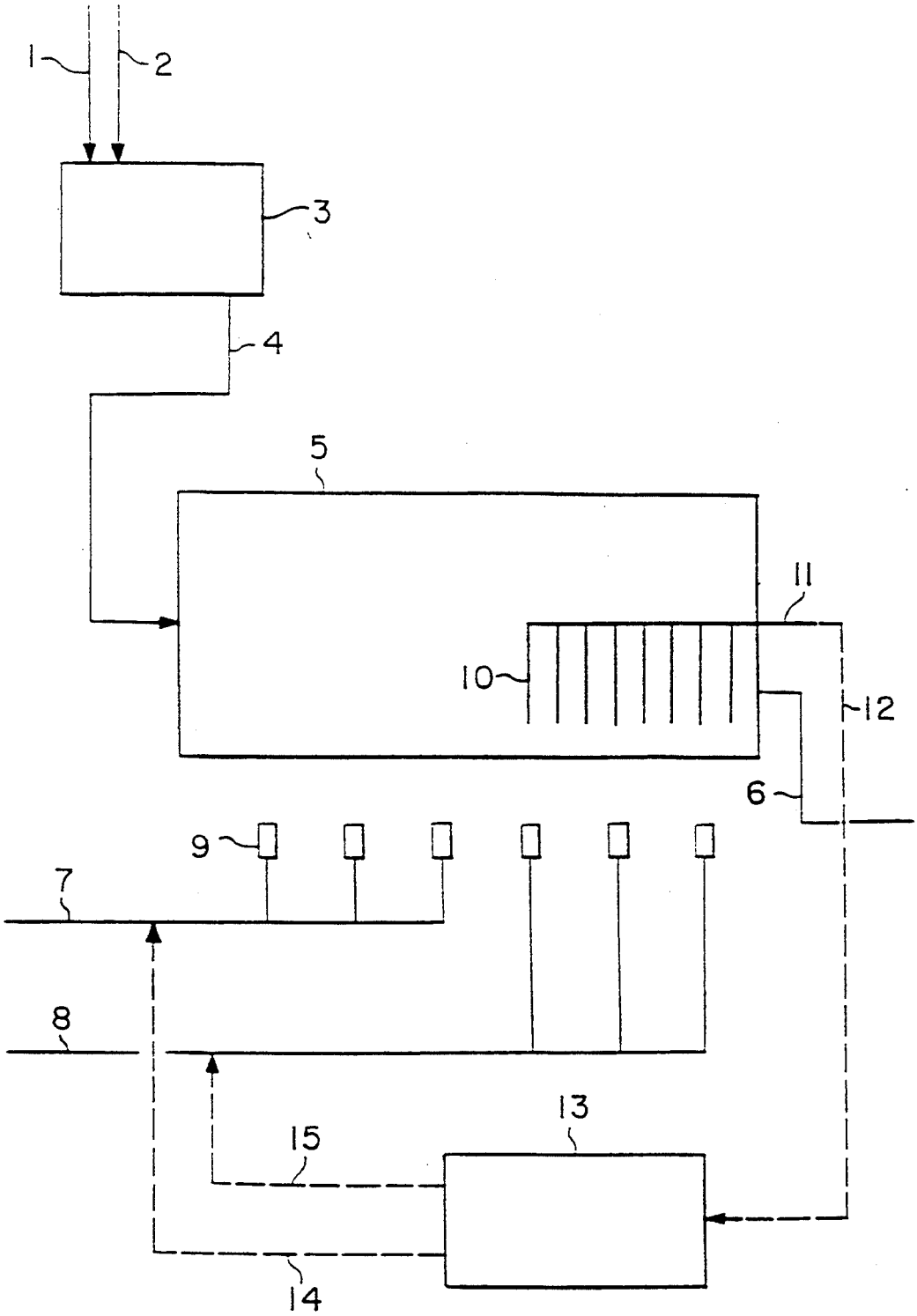
FIG. 1 is a schematic view showing a drying apparatus for carbon black to be granulated by adding water in accordance with an embodiment of the present invention.

FIG. 1 is a schematic view showing an example of the present invention.

In FIG. 1, carbon black is introduced through an inlet 1 of a granulating machine 3 while water is introduced through an inlet 2 of the granulating machine 3. The granulated carbon black is fed to a cylindrical rotary type dryer 5 through a line 4, and the carbon black as a product is discharged through a line 6. Fuel is supplied from a fuel line 7 for the front half portion of the dryer and a fuel line 8 for the rear half portion of the dryer to burners for the front and rear half portions of the dryer 5 respectively. Temperature in the dryer 5 is measured by a plurality of thermometers 10, the thermometers 10 being supported by a supporter 11. Temperature signals 12 are transmitted to a combustion control device 13. The quantity of heat of heat sources in the dryer 5 is controlled by a control signal 14 for the flow rate of fuel for the front half portion of the dryer and a control signal 15 for the flow rate of fuel for the rear half portion of the dryer. Carbon black and water are supplied with substantially the same amount to the granulating machine 3 to be granulated. As the granulating machine, various types may be used. In particular, a granulating machine having a cylindrical shape in which a rotary shaft with agitating pins is disposed is preferably used in order to continuously produce granulated carbon black. The carbon black which is granulated and contains water, produced in the granulating machine 3 is fed to the cylindrical rotary type dryer 5 in which the carbon black is dried to be a product.

As fuel used for the rotary cylindrical type dryer 5, combustible gas such as combustion gas, hydrogen, methane or fossil fuel such as heavy oil, naphtha or the like can be used. The fuel is fed to two or more paths such as the fuel line for the front half portion of the dryer and the fuel line 8 for the rear half portion of the dryer, and the streams of the fuel are controlled independently. The number of fuel lines can be three or more. However, a large number of fuel lines make the structure of the control device 13 complicated. Accordingly, the number of fuel lines is preferably 2 through about 5, more preferably, 2 or 3.

The fuel streams divided into two or more are burnt at the burners 9. The number of the burner 9 can be one to each of the fuel lines 7, 8. However, it is preferable to provide a plurality of burners 9 for each fuel line so as to increase thermal efficiency. In the Examples described herein, each of the burners 9 has the same capacity. However, some of the burners may have different capacities, or some may be attached with a combustion control valve so that calorie from the burners can be adjusted. In order to utilize efficiently heat of the exhaust gas produced from the burners, the exhaust gas can be returned to the dryer 5 (FIG. 3).

The thermometers 10 are disposed in the cylindrical rotary type dryer 5. In arranging them, a plurality of the thermometers 10 may be supported by the supporter 11, and the supporter 11 be inserted in the dryer 5 so that the thermometers 10 come in contact with the carbon black fed into the dryer 5.

As shown in FIG. 1, the thermometers 10 used for this Example are disposed above the burners 9 connected to the fuel line 8 for the rear half portion of the dryer. It is because there is such an economical advantage that the burners for fuel line 7 for the front half portion of the dryer are inclusively used for increasing temperature in the cylindrical rotary type dryer 5, and temperature above the burners 9 for the fuel line 8 for the rear half portion of the dryer in which the critical point turning from a state of constant rate of drying to a state of falling rate of drying, is measured.

Figure 3:
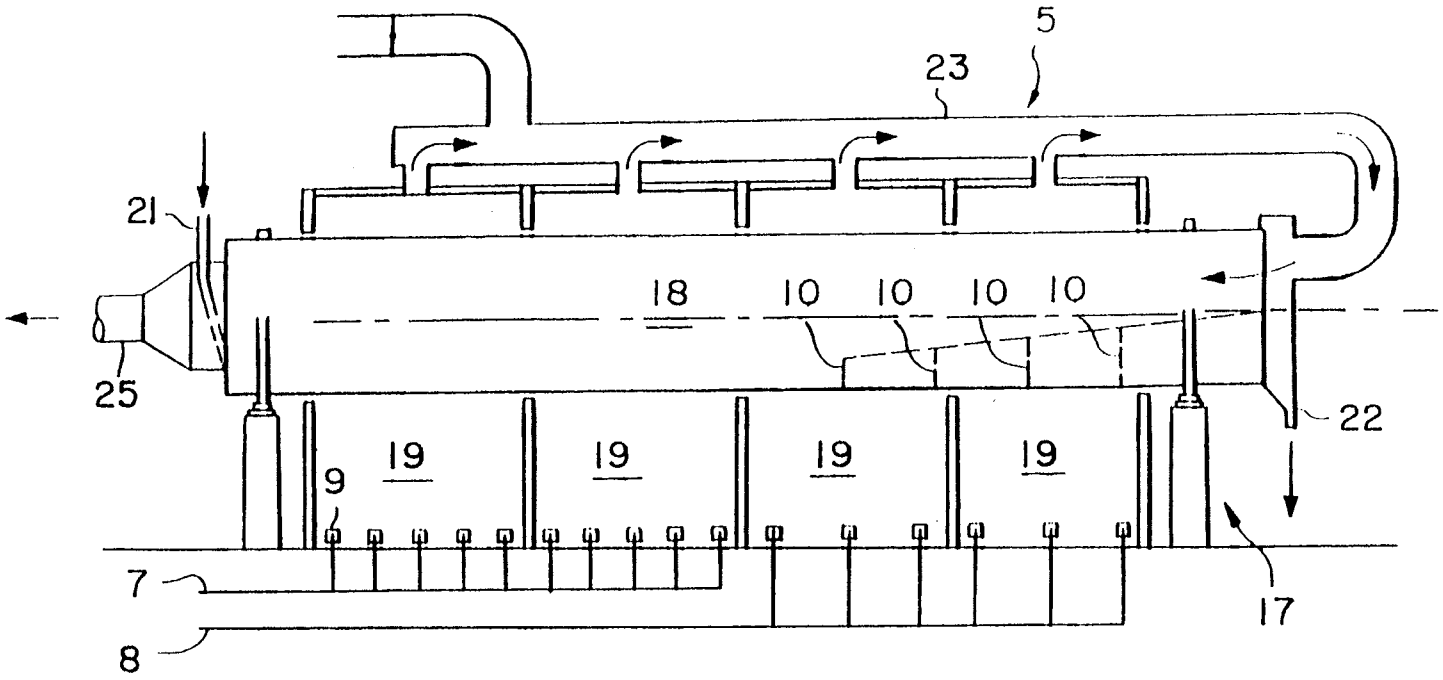
FIG. 3 is a schematic view showing a cylindrical rotary type dryer for carbon black to be granulated by adding water in accordance with an embodiment of the present invention.

FIG. 3 is a diagram showing an example of the cylindrical rotary type dryer 5 in which granulated carbon black is produced by adding water. The upper part of FIG. 3 with respect to a horizontal one-dotted chain line shows the dryer 5 in cross section, and the lower part shows the side view. The dryer 5 comprises an outer shell furnace 17 provided with the burners 9 and a drum made of stainless steel which is rotatable inside the outer shell furnace 17. The outer shell furnace 17 has a diameter of 3.7 m, a height of 5.5 m and a length of 24 m. The inside of the outer shell furnace 17 is divided into four combustion chambers 19 each being arranged at equal intervals. The carbon black granulated by adding water is introduced from an inlet 21 (which is shown at the left hand in the drawing) of the drum 18 and is discharged through an outlet 21 (which is shown at the right end).

Fuel to be supplied is fed to the fuel line 7 for the front half portion of the dryer and the fuel line 8 for the rear half portion, and the flow rate of fuel in the two lines is controlled independently. Among the four combustion chambers 19, the first and second chambers in view of the front of the dryer are supplied with the fuel for the front half portion, and the third and fourth chambers are supplied with the fuel for the rear half portion. The fuel is burnt in a plurality of the burner 9 respectively. Specifically, the fuel for the front half portion is burnt by twenty burners 9 and the fuel for the rear half portion is burnt by twelve burners 9. Namely, each of the first and second chambers has ten burners 9 and each of the third and fourth chambers as six burners 9. In this Example, the total flow rate of the fuel supplied to twenty burners 9 for the front half portion and the total flow rate of the fuel supplied to twelve burners 9 for the rear half portion are independently controlled. Combustion gas produced by burning the fuel in the burners 9 is collected by a duct 23 disposed on the combustion chamber 19 while the drum 18 is heated from the outside, and the collected combustion gas is fed into the drum 18 from the rear portion of the drum to which the duct 13 connected. A blower (not shown) is disposed at the side of a discharge gas outlet 25 and near an inlet 11 for the carbon black so that the combustion gas in the drum 18 is sucked. Namely, the combustion gas forms a counter current to the carbon black and is discharged through the discharge gas outlet 25.

Oxidization takes place when the combustion gas contacts with the carbon black. The degree of oxidization closely relates to the temperature of the carbon black. Accordingly, it is necessary to maintain the temperature profile in the drum 18 constant in order to obtain the product of carbon black of stable quality by keeping the degree of oxidization constant. In the Example, the temperature of the carbon black flowing in the drum 18 is measured at a plurality of measuring points, and the critical point at which the carbon black turns from the constant rate of drying to the falling rate of drying is estimated by collected temperature data and the flow rate of the fuel for the front half portion and the flow rate of the fuel for the rear half portion are independently controlled to obtain a desired temperature profile on the basis of a result of estimation and the temperature of the carbon black at the outlet of the dryer.

In this Example, the temperature of the carbon black in the drum 18 is measured by four thermometers 10 disposed in the third and fourth combustion chambers 19. Namely, the four thermometers are fixed to a supporter (not shown) at intervals of 2.5 m, and the supporter is inserted through the outlet of the drum 18 and fixed thereto.

The values of temperature measured by the thermometers 10 are inputted through one-line into the control device 13 (FIG. 1) at intervals of 10 minutes. On the other hand, the flow rate of fuel for the front half portion, the flow rate of the fuel for the rear half portion and the flow rate of water added to the carbon black are also inputted through on-line into the control device at intervals of 10 minutes. However, in this Example, estimation is made as to how the critical point from the constant rate of drying to the falling rate of drying and the temperature of the carbon black at the outlet by the operations contacted in the past, on the basis of values currently obtained. Accordingly, the flow rate of the fuel for the front half portion, the flow rate of the fuel for the rear half portion and the flow rate of water added to the carbon black are reserved in a memory (not shown) in the control device 13.

A thermal load to the dryer 5 is determined by a loading quantity of the carbon black and a water content added thereto. However, since the thermal capacity of the carbon black is very small as one tenth or lower in comparison with the thermal capacity of water, it is negligible. Therefore, in this Example, the loading quantity of the carbon black is neglected.

The control device 13 estimates a point at which the carbon black becomes a state of falling rate of drying, by calculating temperature data detected at four points. Then, the control device 13 estimates by using the step response model how the temperature of the carbon black at the outlet of the dryer and the critical point turning from the constant rate of drying to the falling rate of drying change on the basis of currently obtainable data and data reserved in the memory which stores the data of the flow rate of the fuel for the front half portion, the flow rate of the fuel for the rear half portion and the flow rate of water collected during 1,500 minutes in the past. Then, it determines an operating quantity which minimizes the surface area of error between a track of estimated value and a target track, i.e. the flow rate of the fuel for front half portion or the flow rate of the fuel for rear half portion, by using a least square method, whereby control signals are supplied to control valves (not shown) for the fuel lines 7, 8. The above-mentioned process is repeated at a period of 10 minutes. Accordingly, a period of control in this Example is 10 minutes.

In this Example, into the carbon black prepared by a furnace method in the granulating machine, substantially the same amount of water is added to produce granulated carbon black having a particle diameter of 2.5 mm or less. The granulated carbon black is fed to the cylindrical rotary type dryer 5. Specifically, about 2,000–3,000 kg/hr of carbon black and substantially the same amount of water are used. On the other hand, as the fuel, coke oven gas (COG) is used wherein an amount of COG for the front half portion is 200–400 $Nm^3/h$ and an amount of COG for the rear half portion is about 100–300 $Nm^3/h$.

The quality of the carbon black as a product, which was obtained in this Example, is such as IA (yode absorbing quantity): 60±4 mg/g, DBP (dibutylphthalate): 105±3 ml/100 g, pH: 6–9, VM (volatile): 1.1±0.4% and water: 0.7% or less.

FIGS. 4 through 6 show data obtained by the temperature control according to Example 1 as well as the temperature control by Comparative Example. In Comparative Example, the heat capacity of carbon black granulated by adding water is previously calculated; the flow rate of the fuel for the front half portion is adjusted to provide the same calorie as the before mentioned thermal capacity, and the flow rate of the fuel for the rear half portion is controlled depending on the temperature of the carbon black at the outlet 22 of the of the dryer.

FIG. 4*a* shows change with time of the temperature of the carbon black at the outlet 22 of the dryer; FIG. 4*b* shows change with time of the distance of the critical point at which the carbon black turns from the constant rate of drying to the falling rate of drying, from inlet 21 of the dryer; FIG. 5*a* shows change with time of the flow rate of fuel for the front half portion; FIG. 5*b* shows change with time of the flow rate of fuel for the rear half portion; and FIG. 6 shows change with time of water content added to carbon black. In FIGS. 4 through 6, the left half portions represent Comparative Examples and the right half portions represent the present invention respectively.

In FIG. 6, there is found change in the amount of water added to the carbon black. It is necessary to control the quantity of heat to be applied to the carbon black by controlling the flow rate of the fuel for the front and rear half portions so that the temperature of the carbon black does not change. In comparison of this Example with the Comparative Example, it is clear that in the Comparative Example, the temperature of the carbon black at the outlet 22 of the dryer (FIG. 4*a*) and the critical point turning from the constant rate of drying to the falling rate of drying (FIG. 4*b*) show large change, while according to this Example, they are stable in spite of a large change of the water content in comparison with the Comparative Example in FIG. 6.

EXAMPLE 2

In the same manner as Example 1 and the Comparative Example described in Example 1, the carbon black was dried continuously for 10 days to obtain a product of the carbon black. The average value and the standard deviation on VM (volatile) and pH of the product were examined. The results is shown in Table 1.

TABLE 1

| | Standard deviation | | Average | |
|---|---|---|---|---|
| | VM | pH | VM | pH |
| Example 2 | 0.086 | 0.155 | 1.415 | 6.600 |
| Comparative Example 1 | 0.092 | 0.291 | 1.317 | 6.617 |

As shown in Table 1, the carbon black obtained by Example 2 shows smaller dispersion than that by Comparative Example. According to Example 2, the carbon black having a stable quality is obtained.

EXAMPLE 3

The same operations as in Example 1 were conducted except that carbon black having different quality was used. The obtained product of carbon black was examined. A result obtained is shown in FIGS. 7 and 8 and Table 2. The quality of the carbon black used in Example 3 is IA: 111±4 mg/g, DBP: 117±3 ml/100 g, pH: 6–9, VM: 1.2–1.5% and water: 2% or less.

COMPARATIVE EXAMPLE 2

The same operations as the Comparative Example described in Example 1 were conducted except that the carbon black used in Example 3 was used. The obtained product of carbon black was examined. FIGS. 9 and 10 and Table 2 show the result of the tests.

TABLE 2

| | Standard deviation | | Average | |
|---|---|---|---|---|
| | VM | pH | VM | pH |
| Example 3 | 0.0550 | 0.2683 | 1.145 | 6.9 |
| Comparative Example 2 | 0.1201 | 0.4457 | 1.3867 | 7.0333 |

Thus, by controlling a temperature profile in a dryer according to the present invention, a stable temperature profile can be obtained for a long time, and the dispersion in the quality of the product of powder and granular material such as carbon black can be small and stable.

We claim:

1. In a drying method of powder and granular material which dries powder and granular material within a time from the introducing of the powder and granular from an end of a dryer having heat sources in plurally divided sections to the discharging of the powder and granular from the other end of the dryer, the drying method being characterized in that the temperature of the powder and granular material in the dryer is measured; a critical point at which a state of drying of the powder and granular material is changed from a constant rate of drying to a falling rate of drying is estimated by calculation on the basis of a result of the temperature measurement and the temperature of the powder and granular material at the outlet of the dryer; and the temperature of the powder and granular material at the outlet of the dryer and the critical point are controlled by controlling independently the quantity of heat of the plural heat sources on the basis of a result of the estimation of the critical point concerning the state of drying of the powder and granular material.

2. The drying method of powder and drying material according to claim 1, wherein the critical point is estimated by calculating the intersection of an approximate expression: $t=K-B\times e\times p\ (-x/T)$, and a temperature of 100° C. where t denotes temperature, x denotes a distance between a leading temperature measuring device at the inlet of the dryer, in a falling rate drying region and another temperature measuring device in the falling rate drying region, and K, B and T are respectively coefficient.

3. The drying method of powder and granular material according to claim 1, wherein the control of the temperature of the powder and granular material at the outlet of the dryer and the critical point is conducted by using at least one among a step response model, an impulse response model and an ARX model.

4. The drying method of powder and granular material according to claim 1, wherein the control of the temperature of the powder and granular material at the outlet of the dryer and the critical point is conducted by using only a step response model.

5. The drying method of powder and granular material according to claim 2, wherein the falling rate drying region has three or more numbers of temperature measuring devices at separate positions.

6. The drying method of powder and granular material according to claim 1, wherein oxidization characteristics of the powder and granular material are largely changed in the falling rate drying region.

7. The drying method of powder and granular material according to claim 6, wherein the powder and granular material is carbon black.

8. In a drying apparatus for drying powder and granular material by heat sources located in plurally divided sections in a dryer having a powder and granular material feeding path which connects an inlet for the powder and granular material at its one end to an outlet at its other end, the drying apparatus being characterized by comprising:

temperature measuring devices for measuring the temperature of the powder and granular material at a plurality of locations in the powder and granular material feeding path in the dryer;

a drying-state-critical-point estimation means for estimating by calculation the critical point at which the drying state of the powder and granular material changes from a constant rate of drying to a falling rate of drying, on the basis of a result of the measurement of the powder and granular material by the temperature measuring devices; and a combustion control device means which operates independently the quantity of heat from the plurality of heat sources on the basis of a result of the estimation by the drying-state-critical-point estimation means and the temperature of the powder and granular material at the outlet of the dryer, whereby the temperature of the powder and granular material at the outlet of the dryer and the critical point of the drying state are controlled.

9. The drying apparatus for powder and drying material according to claim 8, wherein the critical point is estimated by calculating the intersection of an approximate expression: $t=K-B\times e\times p\ (-x/T)$, and a temperature of 100° C. where t denotes temperature, x denotes a distance between a leading temperature measuring device at the inlet of the dryer, in a falling rate drying region and another temperature measuring device in the falling rate drying region, and K, B and T are respectively coefficients.

10. The drying apparatus for powder and granular material according to claim 8, wherein the controlling by the combustion control device means of the temperature of the powder and granular material at the outlet of the dryer and the critical point is conducted by using at least one among a step response model, an impulse response model and an ARX model.

11. The drying apparatus for powder and granular material according to claim 8, wherein the controlling by the combustion control device means of the temperature of the powder and granular material at the outlet of the dryer and the critical point is conducted by using only a step response model.

12. The drying apparatus for powder and granular material according to claim 9, wherein the falling rate drying region has three or more numbers of temperature measuring devices at separate positions.

13. The drying apparatus for powder and granular material according to claim 8, wherein oxidization characteristics of the powder and granular material are largely changed in the falling rate drying region.

14. The drying apparatus for powder and granular material according to claim 13, wherein the powder and granular material is carbon black.

* * * * *